US006443503B1

(12) United States Patent
Fan Lu et al.

(10) Patent No.: US 6,443,503 B1
(45) Date of Patent: Sep. 3, 2002

(54) DUAL BACKSET DEADBOLT ASSEMBLY

(76) Inventors: Chao-Jung Fan Lu, 13F, No. 199-1, Kuang-Fu N. Rd., Sung-Shan Dist., Taipei City (TW); Yung-Chen Lin, 3F, No. 27, Jen-Yi-Hsin-Tsun, Tung Dist., Chia-Yi City (TW)

( * ) Notice: Subject to any disclaimer, the term of this patent is extended or adjusted under 35 U.S.C. 154(b) by 0 days.

(21) Appl. No.: 09/796,789

(22) Filed: Mar. 2, 2001

(51) Int. Cl.[7] ..... E05C 1/00

(52) U.S. Cl. ..... 292/1.5; 292/DIG. 60; 70/461

(58) Field of Search ..... 292/1.5, DIG. 60; 70/461

(56) References Cited

U.S. PATENT DOCUMENTS 4,639,025 A * 1/1987 Fann et al. ..... 292/1
4,768,817 A * 9/1988 Fann et al. ..... 292/1
4,927,195 A * 5/1990 Wu et al. ..... 292/1.5
4,957,315 A * 9/1990 Lin ..... 292/1.5
4,976,122 A * 12/1990 Doolan et al. ..... 292/1.5
RE34,240 E * 5/1993 Lin ..... 292/337
6,318,769 B1 * 11/2001 Kang ..... 292/1.5

* cited by examiner

*Primary Examiner*—J. J. Swann
*Assistant Examiner*—Dinesh Melwani
(74) *Attorney, Agent, or Firm*—Baker Botts, L.L.P.

(57) ABSTRACT

A dual backset deadbolt assembly includes a deadbolt housing that houses a deadbolt, a crank retainer disposed slidably in an extension housing that is connected to the deadbolt housing, a transmission plate connected to the deadbolt, a linking plate pivoted to the transmission plate, and a crank member retained rotatably in the crank retainer. The extension housing has first and second backset holes. The crank retainer includes an actuating member having a top wall formed with first and second positioning holes and an actuating aperture, and a holding member having side plates formed with crank retaining holes. The linking plate has a rear end extending below the top wall and formed with an upward positioning projection, and is biased upward by a biasing spring so as to engage the positioning projection with one of the first and second positioning holes. The crank member has an actuating protrusion which projects upwardly through the actuating aperture so as to engage the actuating member. The positioning projection is depressible to permit the crank retainer to be moved in the longitudinal direction relative to the extension housing in order to enable the positioning projection to engage the other one of the first and second positioning holes.

5 Claims, 4 Drawing Sheets

DUAL BACKSET DEADBOLT ASSEMBLY

BACKGROUND OF THE INVENTION

1. Field of the Invention

The present invention relates to a dual backset deadbolt assembly, more particularly to a dual backset deadbolt assembly which has a simplified construction and which is easier to operate for adjusting between longer and shorter backset lengths.

2. Description of the Related Art

U.S. Pat. No. 4,639,025 discloses an adjustable deadbolt assembly which includes a bolt casing that houses a bolt, an extension housing fixed to a rear end of the bolt casing, a crank plate mounted in the extension housing, an adjustable bolt extension member connected to a rear end of the bolt and housed in the extension housing, a disengaging pin, and crank plate holding means. The extension housing is formed with an oblong pin hole. The crank plate is to be connected to a spindle for transmitting the actuation of the spindle to the bolt, and is turnable about an axis to move the bolt between a locking position and a releasing position. The bolt extension member includes a fixed plate member and an extensible channel member pivoted to the fixed plate. The extensible channel member is formed with a longitudinal guide aperture which has front and rear engaging portions. A pivot pin extends through the fixed plate member and the guide aperture in the extensible channel member, and is movable along the guiding aperture for engaging selectively the front and rear engaging portions. The disengaging pin extends through the oblong pin hole in the extension housing, and is movable along the oblong pin hole for disengaging the pivot pin from the front or rear engaging portion. The crank plate holding means is mounted movably in the extension housing to hold the crank plate in a movable position so that the crank plate can be kept in a cooperative relationship with the extensible channel member. The crank plate holding means is formed with front and rear notches. The disengaging pin engages the front notch when the pivot pin engages the front engaging portion of the guide aperture, and engages the rear notch when the pivot pin engages the rear engaging portion of the guide aperture. To adjust the backset length of the deadbolt assembly, the disengaging pin is moved upward in the oblong pin hole using one hand of the user to disengage from the front or rear notch and to disengage the pivot pin from the front or rear engaging portion of the guide aperture. Then, the crank plate holding means is pulled backward or pushed forward using the other hand of the user, with said one hand of the user holding the disengaging pin. As such, the adjustment operation requires both hands of the user, and is inconvenient to conduct. Moreover, with the use of the disengaging pin, which is movable along the oblong pin hole, for disengaging the extensible channel member and the crank plate holding means from the longer or shorter backset position, the aforesaid deadbolt assembly has a relatively complicated structure which unavoidably results in an increase in the manufacturing and assembly costs.

SUMMARY OF THE INVENTION

Therefore, the main object of the present invention is to provide a dual backset deadbolt assembly which has a simplified construction and which is easier to operate for adjusting between longer and shorter backset lengths.

Accordingly, the dual backset deadbolt assembly of the present invention includes a deadbolt housing, a deadbolt, an extension housing, a crank retainer, a transmission plate, a linking plate, a biasing spring, and a crank member. The deadbolt housing has a front end and a rear end opposite to the front end in a longitudinal direction. The deadbolt is mounted in the deadbolt housing, and is movable along the longitudinal direction between an extended position and a retracted position relative to the front end of the deadbolt housing. The extension housing is fixed to the rear end of the deadbolt housing. The extension housing has two parallel side plates which are connected to each other so as to confine a slide chamber with an open front end. Each of the side plates has first and second backset holes displaced from each other along the longitudinal direction. The crank retainer is disposed slidably in the slide chamber, and includes an upper actuating member which has a top wall that extends along the longitudinal direction and that is exposed from the extension housing. The top wall is formed with first and second positioning holes which are displaced from each other along the longitudinal direction. The top wall is further formed with an actuating aperture. The crank retainer further includes a lower holding member disposed below the actuating member. The holding member has two side panels which are parallel to the side plates of the extension housing and which are formed with aligned crank retaining holes. The transmission plate has a front end fixed to the deadbolt. The linking plate has a front end connected pivotally to the front end of the transmission plate so as to be pivotable about a horizontal axis transverse to the longitudinal direction, and a rear end which extends into the crank retainer so as to be disposed below the top wall of the actuating member and which is formed with an upward positioning projection. The biasing spring biases the rear end of the linking plate upward so as to engage the positioning projection with one of the first and second positioning holes in the top wall of the actuating member, thereby aligning the crank retaining holes with one of the first and second backset holes in the extension housing. The crank member, which is sandwiched between the side panels of the holding member, has a lower end portion retained rotatably in the crank retaining holes and formed with a spindle engaging hole that is aligned with the crank retaining holes, and an upper end formed with an actuating protrusion which projects upwardly through the actuating aperture in the top wall of the actuating member so as to engage the actuating member. The crank member is adapted to be coupled co-rotatably with the deadbolt operating spindle when the deadbolt operating spindle is inserted into the spindle engaging hole. Rotation of the crank member causes the actuating protrusion to move the actuating member along the longitudinal direction, thereby moving the linking plate and the transmission plate along the longitudinal direction relative to the extension housing, and thereby moving the deadbolt between the extended and retracted positions. The positioning projection is depressible against biasing action of the biasing spring for retracting into said one of the first and second positioning holes so as to permit the crank retainer to be moved along the longitudinal direction relative to the extension housing in order to enable the positioning projection to engage the other one of the first and second positioning holes and in order to align the crank retaining holes with the other one of the first and second backset holes, thereby permitting adjustment of the deadbolt assembly between longer and shorter backset lengths.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
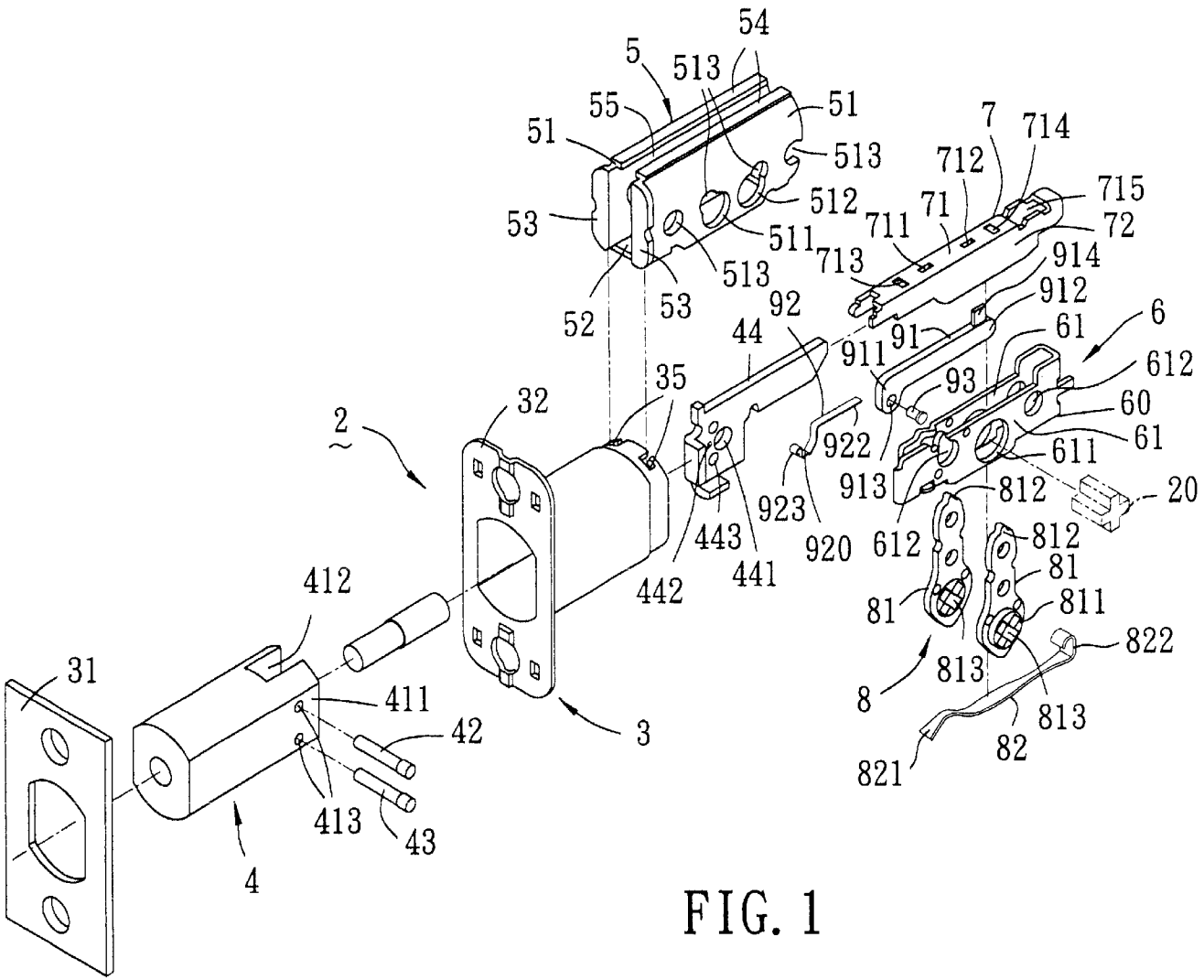
FIG. 1 is an exploded perspective view of a preferred embodiment of a dual backset deadbolt assembly according to the present invention.
Figure 2:
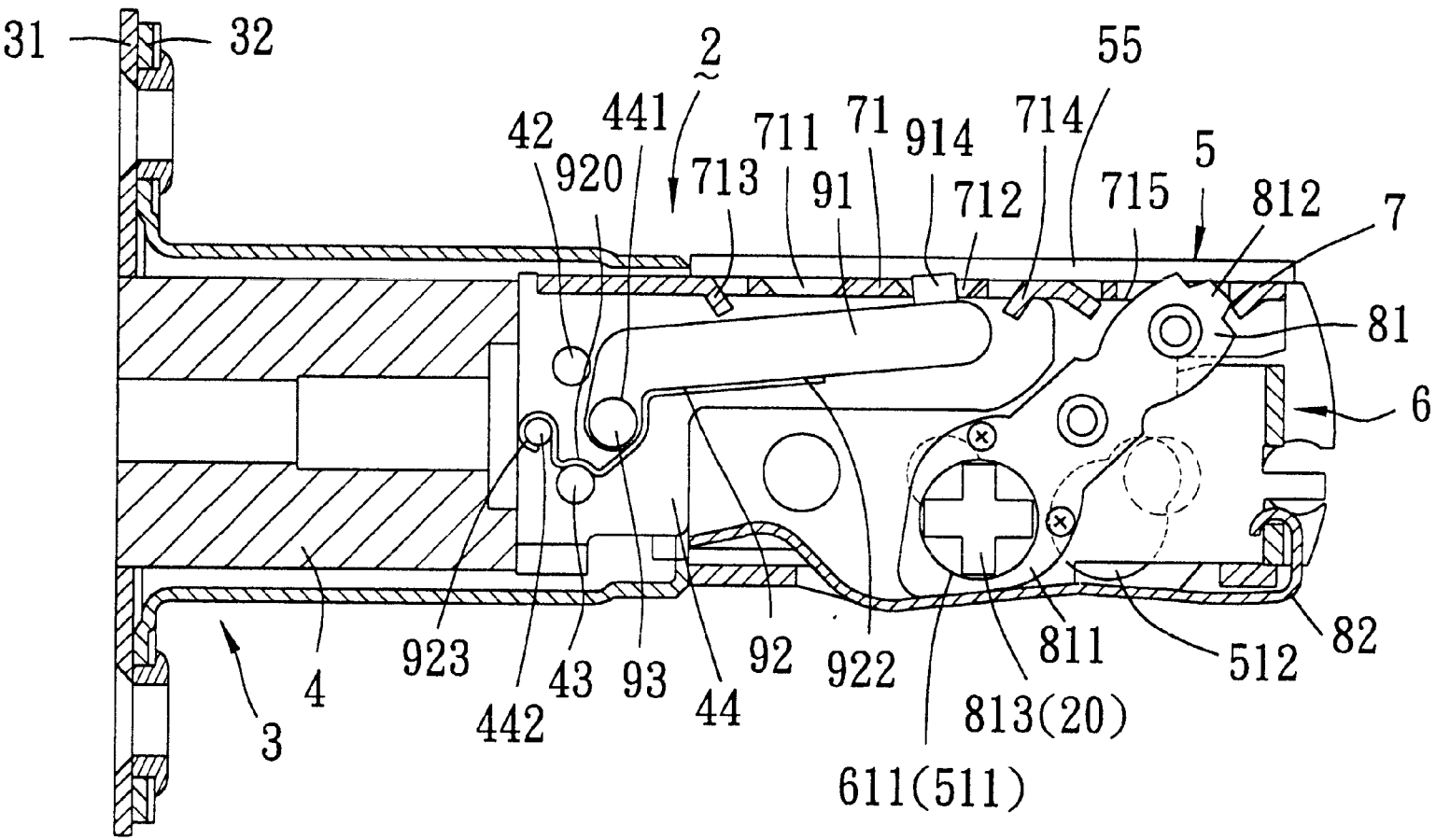
FIG. 2 is a sectional view illustrating the preferred embodiment in a shorter backset length position and in an unlocking state.

Referring to FIGS. 1 and 2, the preferred embodiment of the dual backset deadbolt assembly 2 according to the present invention is used for a lock having a deadbolt operating spindle 20, and is shown to include a deadbolt housing 3, a deadbolt 4, an extension housing 5, a crank retainer 6, a transmission plate 44, a linking plate 91, a biasing spring 92, and a crank member 8.

The deadbolt housing 3 has a front flange 32 at its front end and secured to a face plate 31, and a rear end opposite to the front end in a longitudinal direction. The rear end of the deadbolt housing 3 is formed with a pair of vertical insert grooves 35. The deadbolt 4 is housed in the deadbolt housing 3, and is movable in the longitudinal direction relative to the face plate 31 between an extended position, in which the deadbolt assembly 2 is in a locking state (see FIG. 3), and a retracted position, in which the deadbolt assembly is in an unlocking state (see FIGS. 2 and 4). The deadbolt 4 has a rear end 411 formed with a vertical groove 412 and a pair of pin holes 413 transverse to the groove 412.

The extension housing 5 has two parallel side plates 51 which are connected to each other so as to define a longitudinally extending slide chamber 52 with open front and rear ends. Each of the side plates 51 has an outwardly extending flange 53 at its front end. The extension housing 5 is secured to the rear end of the deadbolt housing 3 by inserting the flanges 53 into the insert grooves 35, respectively. Each of the side plates 51 further has a top flange 54 at its upper end. The top flanges 54 extend toward each other and cooperatively define a longitudinal slit 55 communicated with the slide chamber 52. Each of the side plates 51 is formed with a first backset hole 511, a second backset hole 512 displaced from the first backset hole 511 in the longitudinal direction and posterior to the first backset hole 511, and a plurality of fastener holes 513.

The crank retainer 6 is disposed slidably in the slide chamber 52 in the extension housing 5, and includes an upper actuating member 7 and a lower holding member 60. The actuating member 7 has an elongated top wall 71 which extends in the longitudinal direction and which is exposed from the extension housing 5 via the slit 55, and a pair of wings 72 extending downwardly from the top wall 71. The top wall 71 is formed with an actuating aperture 715 proximate to its rear end, and has front and rear stop projections 713, 714 formed by punching. The stop projections 713, 714 project downwardly and are arranged along the longitudinal direction. Between the stop projections 713, 714, the top wall 71 is further formed with a first positioning hole 711 and a second positioning hole 712 posterior to the first positioning hole 711 and displaced from the first positioning hole 711 in the longitudinal direction by a distance corresponding to that between the first and second backset holes 511, 512 in the extension housing 5.

The holding member 60 is disposed immediately below the actuating member 7, and has a pair of side panels 61 connected to each other and parallel to the side plates 51 of the extension housing 5. The side panels 61 are formed with aligned circular crank retaining holes 611, and fastener holes 612.

The crank member 8 includes a pair of crank plates 81 attached to each other and sandwiched between the side panels 61 of the holding member 60 so as to be held by the holding member 60. Each of the crank plates 81 has a lower end portion formed with a circular retaining boss 811 which extends into and which is retained rotatably in the crank retaining hole 611 in a respective one of the side panels 61 of the holding member 60, and an upper end formed with an actuating protrusion 812 which projects upwardly through the actuating aperture 715 in the top wall 71 of the actuating member 71 so as to engage the top wall 71 of the actuating member 7. The retaining boss 811 is formed with a spindle engaging hole 813 which is aligned with the crank retaining holes 611 in the holding member 60 and which is adapted to permit insertion of the deadbolt operating spindle 20 therethrough. A spring plate 82 is disposed at a bottom end of the holding member 60, and abuts against bottom edges of the crank plates 81. The spring plate 82 has a first end 821 engaging a front end of the holding member 60, and a hooked second end 822 hooking at a rear end of the holding member 60.

The transmission plate 44 has a front end extending into the vertical groove 412 in the rear end 411 of the deadbolt 4 and fixed to the deadbolt 4 by means of upper and lower connecting pins 42, 43 that extend through the pin holes 413 in the rear end 411 of the deadbolt 4 and through a pair of pin holes 443 in the front end of the transmission plate 44. A mounting protrusion 442 and a pivot hole 441 are formed in the front end of the transmission plate 44. The transmission plate 44 extends into the slide chamber 52 of the extension housing 5 via the open front end of the latter.

The linking plate 91 has a front end 911 connected pivotally to the front end of the transmission plate 44 by means of a horizontal pivot pin 93 that is transverse to the longitudinal direction and that extends through a pivot hole 913 in the front end 911 of the linking plate 91 and through the pivot hole 441 in the front end of the transmission plate 44. The linking plate 91 has a rear end 912 extending into the crank retainer 6 so as to be disposed below the top wall 71 of the actuating member 7. The rear end 912 is formed with an upward positioning projection 914. The biasing spring 92, which is in the form of a spring plate, has a hooked mounting end 923 hooked at the mounting protrusion 442 at the front end of the transmission plate 44, a pushing end 922 opposite to the mounting end 923 and disposed at a bottom side of the linking plate 91, and an abutting portion 920 proximate to the mounting end 923 and abutting against the lower connecting pin 43. The biasing spring 92 thus pushes the rear end 912 of the linking plate 91 upward so as to engage the positioning projection 914 with one of the first and second positioning holes 711, 712 in the top wall 71 of the actuating member 7, thereby aligning the crank retaining holes 611 in the holding member 60 with one of the first and second backset holes 511, 512 in the extension housing 5, and thereby aligning the fastener holes 612 in the holding member 60 with two of the fastener holes 513 in the extension housing 5.

Figure 3:
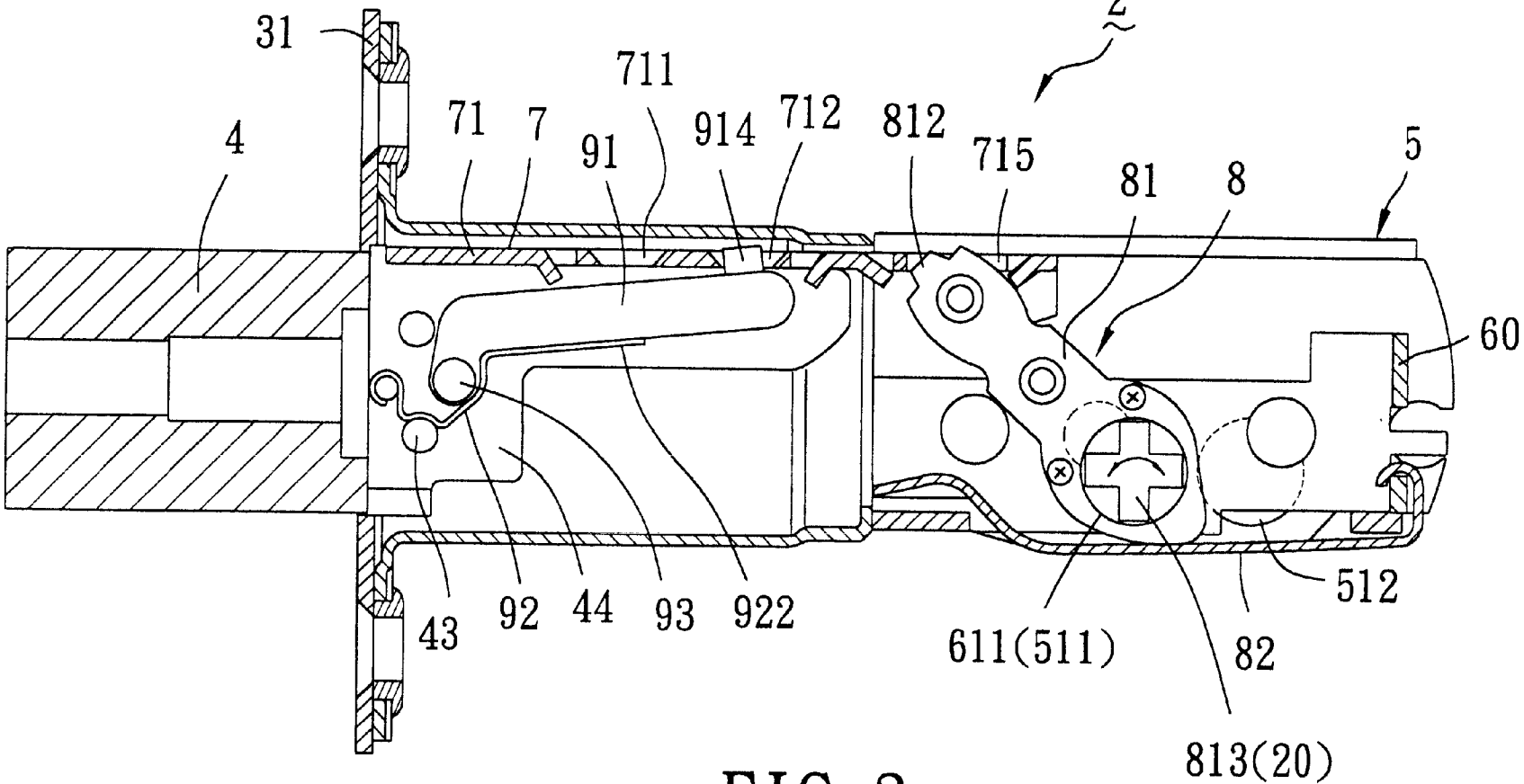
FIG. 3 is a sectional view illustrating the preferred embodiment in the shorter backset length position and in a locking state.

Referring to FIGS. 2 and 3, when the deadbolt assembly 2 is incorporated in a lock (not shown), the deadbolt operating spindle 20 is inserted into the spindle engaging holes 813 so as to be coupled co-rotatably with the crank plates 81. In use, when the spindle 20 is operated to rotate the crank plates 81, the actuating protrusions 812 on the crank plates 81 move the actuating member 7 along the longitudinal direction due to engagement between the actuating protrusions 812 and the actuating aperture 715 in the top wall 71. The actuating member 7, in turn, moves the linking plate 91 and the transmission plate 44 in the longitudinal direction due to the engagement between the positioning projection 914 and one of the first and second positioning holes 711, 712, and due to the connection of the pivot pin 93, thereby moving the deadbolt 4 between the extended position shown in FIG. 3 and the retracted position shown in FIG. 2.

Figure 4:
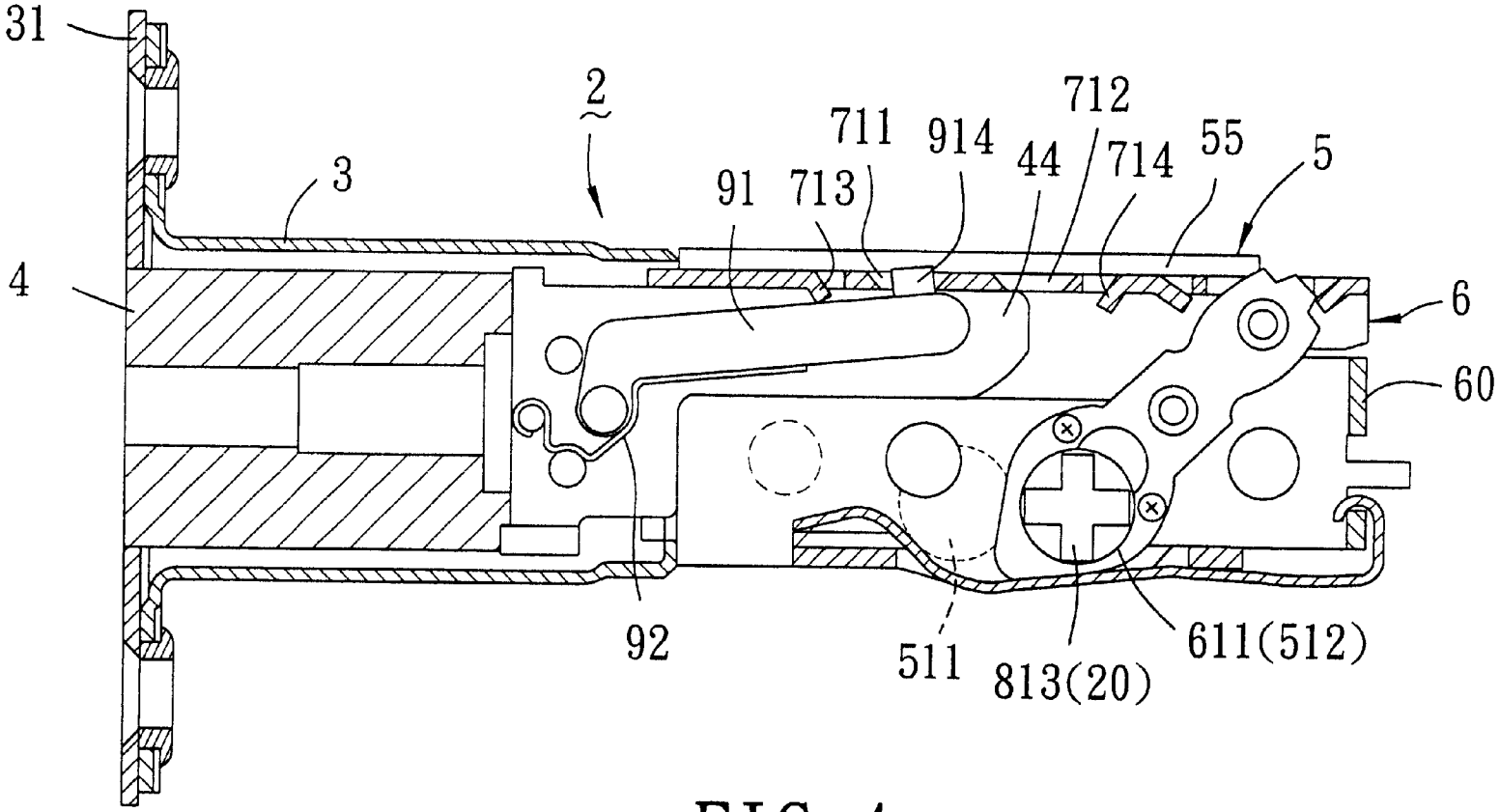
FIG. 4 is a sectional view illustrating the preferred embodiment in a longer backset length position and in an unlocking state.

Referring to FIGS. 2 and 4, to adjust the backset length of the deadbolt assembly 2 before the latter is assembled with the spindle 20, the positioning projection 914 is depressed against biasing action of the spring 92 for retracting into the initial one of the first and second positioning holes 711, 712. Then, the actuating member 7 and the holding member 60 are pulled rearwardly or pushed forwardly along the longitudinal direction relative to the extension housing 5 until the positioning projection 914 engages the other one of the first and second positioning holes 711, 712. At this time, the crank retaining holes 611 in the holding member 60 and the spindle engaging holes 813 in the crank plates 81 are moved along the longitudinal direction to align with the other one of the first and second backset holes 511, 512 in the extension housing 5. It is noted that the depression operation and the pulling or pushing operation can be accomplished using a single hand of the user. Therefore, the adjustment operation can be easily conducted.

The stop projections 713, 714 serve to limit movement of the crank retainer 6 along the longitudinal direction when the crank retainer 6 is pulled rearwardly or pushed forwardly during adjustment of the backset length.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

We claim:

1. A dual backset deadbolt assembly for a lock with a deadbolt operating spindle, said deadbolt assembly being adjustable between shorter and longer backset lengths and comprising:

a deadbolt housing having a front end and a rear end opposite to the front end in a longitudinal direction;

a deadbolt mounted in said deadbolt housing and movable along said longitudinal direction between an extended position and a retracted position relative to said front end of said deadbolt housing;

an extension housing fixed to said rear end of said deadbolt housing, said extension housing having two parallel side plates which are connected to each other so as to confine a slide chamber with an open front end, each of said side plates having first and second backset holes displaced from each other along said longitudinal direction;

a crank retainer disposed slidably in said slide chamber, said crank retainer including an upper actuating member which has a top wall that extends in said longitudinal direction and that is exposed from said extension housing, said top wall being formed with first and second positioning holes which are displaced from each other along said longitudinal direction, said top wall being further formed with an actuating aperture, said crank retainer further including a lower holding member disposed below said actuating member, said holding member having two side panels which are parallel to said side plates of said extension housing and which are formed with aligned crank retaining holes;

a transmission plate having a front end fixed to said deadbolt;

a linking plate having a front end connected pivotally to said front end of said transmission plate so as to be pivotable about a horizontal axis transverse to said longitudinal direction, and a rear end which extends into said crank retainer so as to be disposed below said top wall of said actuating member and which is formed with an upward positioning projection;

a biasing spring for biasing said rear end of said linking plate upward so as to engage said positioning projection with one of said first and second positioning holes in said top wall of said actuating member, thereby aligning said crank retaining holes with one of said first and second backset holes in said extension housing; and a crank member sandwiched between said side panels of said holding member, said crank member having a lower end portion retained rotatably in said crank retaining holes and formed with a spindle engaging hole that is aligned with said crank retaining holes, and an upper end formed with an actuating protrusion which projects upwardly through said actuating aperture in said top wall of said actuating member so as to engage said actuating member, said crank member being adapted to be coupled co-rotatably with the deadbolt operating spindle when the deadbolt operating spindle is inserted into said spindle engaging hole, rotation of said crank member causing said actuating protrusion to move said actuating member along said longitudinal direction, thereby moving said linking plate and said transmission plate along said longitudinal direction relative to said extension housing, and thereby moving said deadbolt between the extended and retracted positions;

said positioning projection being depressible against biasing action of said biasing spring for retracting into said one of said first and second positioning holes so as to permit said crank retainer to be moved along said longitudinal direction relative to said extension housing in order to enable said positioning projection to engage the other one of said first and second positioning holes and in order to align said crank retaining holes with the other one of said first and second backset holes, thereby permitting adjustment of said deadbolt assembly between the longer and shorter backset lengths.

2. The dual backset deadbolt assembly as claimed in claim 1, wherein said top wall of said actuating member is formed with front and rear stop projections arranged along said longitudinal direction, said first and second positioning holes being disposed between said front and rear stop projections, said stop projections projecting downwardly so as to limit movement of said crank retainer in said longitudinal direction relative to said linking plate during adjustment between the longer and shorter backset lengths.

3. The dual backset deadbolt assembly as claimed in claim 1, wherein said biasing spring is disposed below said linking plate, and is formed as a spring plate with a mounting end connected to said front end of said transmission plate, and a pushing end opposite to said connecting end for pushing said rear end of said linking plate upwardly.

4. The dual backset deadbolt assembly as claimed in claim 3, wherein said front end of said transmission plate is formed with a mounting protrusion, said mounting end of said spring being hooked at said mounting protrusion.

5. The dual backset deadbolt assembly as claimed in claim 1, wherein said extension housing has an upper end formed with a longitudinal slit that is communicated with said slide chamber, said top wall of said actuating member being exposed from said slit so as to permit access to said positioning projection via said slit.

* * * * *